US007208998B2

(12) United States Patent
Abel

(10) Patent No.: US 7,208,998 B2
(45) Date of Patent: Apr. 24, 2007

(54) BIAS CIRCUIT FOR HIGH-SWING CASCODE CURRENT MIRRORS

(75) Inventor: Christopher J. Abel, Coplay, PA (US)

(73) Assignee: Agere Systems Inc., Allentown, PA (US)

( * ) Notice: Subject to any disclaimer, the term of this patent is extended or adjusted under 35 U.S.C. 154(b) by 106 days.

(21) Appl. No.: 11/103,813

(22) Filed: Apr. 12, 2005

(65) Prior Publication Data

US 2006/0226893 A1 Oct. 12, 2006

(51) Int. Cl.
*G05F 1/10* (2006.01)
*G05F 3/02* (2006.01)

(52) U.S. Cl. ..... 327/538; 327/543; 323/315; 330/288

(58) Field of Classification Search ..... None
See application file for complete search history.

(56) References Cited

U.S. PATENT DOCUMENTS 5,180,967 A * 1/1993 Yamazaki ..... 323/315
5,359,296 A * 10/1994 Brooks et al. ..... 330/288
5,680,038 A 10/1997 Fiedler
6,169,456 B1 * 1/2001 Pauls ..... 330/288
6,194,886 B1 * 2/2001 D'Aquino et al. ..... 323/315
6,897,717 B1 * 5/2005 Eddleman et al. ..... 327/543
6,965,270 B1 * 11/2005 Ross ..... 330/311
7,078,974 B2 * 7/2006 Matsushita et al. ..... 330/285
2004/0104765 A1 * 6/2004 Ebner ..... 327/543

OTHER PUBLICATIONS

V.C. Vincence et al., "A High-Swing MOS Cascode Bias Circuit," IEEE Transactions on Circuits and Systems-II: Analog and Digital Signal Processing, vol. 47, No. 11, pp. 1325-1328, Nov. 2000.

* cited by examiner

*Primary Examiner*—Tuan T. Lam

(57) ABSTRACT

A bias circuit for providing at least first and second bias signals for biasing a cascode current source and/or a cascode current sink includes a resistive element and first, second and third transistors, each transistor having first and second source/drain terminals and a gate terminal. The first source/drain terminal of the first transistor is coupled to the gate terminal, the first bias signal being generated at the first source/drain terminal in response to receiving a first reference current at the first source/drain terminal. A first end of the first resistive element is coupled to the second source/drain terminal of the first transistor. The gate terminal of the second transistor is coupled to the gate terminal of the first transistor, the second bias signal being generated at the first source/drain terminal of the second transistor in response to receiving a second reference current at the first source/drain terminal of the second transistor. The first source/drain terminal of the third transistor is coupled to the second source/drain terminal of the second transistor, the second source/drain terminal of the third transistor is coupled to a second end of the first resistive element, and the gate terminal of the third transistor is coupled to the first source/drain terminal of the second transistor.

18 Claims, 2 Drawing Sheets

BIAS CIRCUIT FOR HIGH-SWING CASCODE CURRENT MIRRORS

FIELD OF THE INVENTION

The present invention relates generally to electronic circuits, and more particularly relates to improved bias circuits suitable for biasing high-swing cascode current sources and/or current sinks.

BACKGROUND OF THE INVENTION

Current mirrors, which are used primarily as a means for replicating a reference current, are employed in a variety of analog circuits, such as, but not limited to, reference generators, amplifiers, and digital-to-analog converters. A current mirror is designed to receive a reference current and to generate an output current which is identical to, or proportional to, the reference current at an output of the current mirror. A current mirror typically includes a current source and/or a current sink, and a bias circuit for biasing the current source and/or current sink. An ideal current mirror may be characterized as having essentially an infinite parallel output impedance, such that its output current is independent of the voltage at its output. The ideal current mirror is also independent of semiconductor process, supply voltage, and/or temperature (PVT) variations. In practice, however, the output impedance of a current mirror is finite, such that the output current generated by the current mirror is influenced, at least to some extent, by variations in the voltage at the output of the current mirror. Moreover, both the output impedance and the output current generated by the current mirror are typically affected by PVT variations to which the current mirror may be subjected.

Cascode current mirrors represent a particular class of current mirrors which typically include two or more transistor devices connected in a stacked configuration, thereby significantly increasing an output impedance of the current mirror. Such cascode current mirrors are designed to replicate the reference current with a higher degree of precision compared to simple current mirrors (e.g., Wilson current mirror, etc.), and are therefore preferred. Unfortunately, however, cascode current mirrors typically require more voltage headroom to operate properly, and therefore cannot tolerate as large of an output voltage swing as can be tolerated by simple current mirror arrangements. Voltage headroom may be characterized as the output voltage of the current mirror below which one or more transistor devices in the current mirror have gone out of a saturation region of operation. Consequently, most cascode current mirrors are not suitable for use in a low-voltage power supply environment.

While several improvements have been made to the basic current mirror configuration, these improvements still have one or more disadvantages associated therewith. These disadvantages include, but are not limited to, low output impedance, low output voltage swing, high susceptibility to PVT variations, etc. Accordingly, there exists a need for an improved bias circuit for biasing a cascode current source and/or current sink that does not suffer from one or more of the problems exhibited by conventional bias circuits.

SUMMARY OF THE INVENTION

The present invention meets the above-noted need by providing, in an illustrative embodiment, an improved bias circuit for biasing high-swing cascode current mirrors suitable for use with a low-voltage power supply.

In accordance with one aspect of the invention, a bias circuit for providing at least first and second bias signals for biasing a cascode current source and/or a cascode current sink includes a resistive element and first, second and third transistors, each transistor having first and second source/drain terminals and a gate terminal. The first source/drain terminal of the first transistor is coupled to the gate terminal, the first bias signal being generated at the first source/drain terminal in response to receiving a first reference current at the first source/drain terminal. A first end of the first resistive element is coupled to the second source/drain terminal of the first transistor. The gate terminal of the second transistor is coupled to the gate terminal of the first transistor, the second bias signal being generated at the first source/drain terminal of the second transistor in response to receiving a second reference current at the first source/drain terminal of the second transistor. The first source/drain terminal of the third transistor is coupled to the second source/drain terminal of the second transistor, the second source/drain terminal of the third transistor is coupled to a second end of the first resistive element, and the gate terminal of the third transistor is coupled to the first source/drain terminal of the second transistor.

In accordance with another aspect of the invention, an integrated circuit includes at least one bias circuit for providing at least first and second bias signals for biasing a cascode current source and/or a cascode current sink. The bias circuit includes a resistive element, and first, second and third transistors, each transistor having first and second source/drain terminals and a gate terminal. The first source/drain terminal of the first transistor is coupled to the gate terminal, the first bias signal being generated at the first source/drain terminal in response to receiving a first reference current at the first source/drain terminal. A first end of the first resistive element is coupled to the second source/drain terminal of the first transistor. The gate terminal of the second transistor is coupled to the gate terminal of the first transistor, the second bias signal being generated at the first source/drain terminal of the second transistor in response to receiving a second reference current at the first source/drain terminal of the second transistor. The first source/drain terminal of the third transistor is coupled to the second source/drain terminal of the second transistor, the second source/drain terminal of the third transistor is coupled to a second end of the first resistive element, and the gate terminal of the third transistor is coupled to the first source/drain terminal of the second transistor.

These and other features and advantages of the present invention will become apparent from the following detailed description of illustrative embodiments thereof, which is to be read in connection with the accompanying drawings.

DETAILED DESCRIPTION OF THE INVENTION

The present invention will be described herein in the context of illustrative bias circuits. It should be understood, however, that the present invention is not limited to these or any particular circuit arrangements. Rather, the invention is more generally applicable to techniques for generating cascode bias voltages for biasing high-swing cascode current sources and/or current sinks. Although implementations of the present invention are described herein with specific reference to p-channel metal-oxide-semiconductor (PMOS) and n-channel metal-oxide-semiconductor (NMOS) transistor devices, as may be formed using a complementary metal-oxide-semiconductor (CMOS) fabrication process, it is to be understood that the invention is not limited to such transistor devices and/or such a fabrication process, and that other suitable devices, such as, for example, bipolar junction transistors (BJTs), etc., and/or fabrication processes (e.g., bipolar, BiCMOS, etc.), may be similarly employed, as will be apparent to those skilled in the art.

Figure 1:
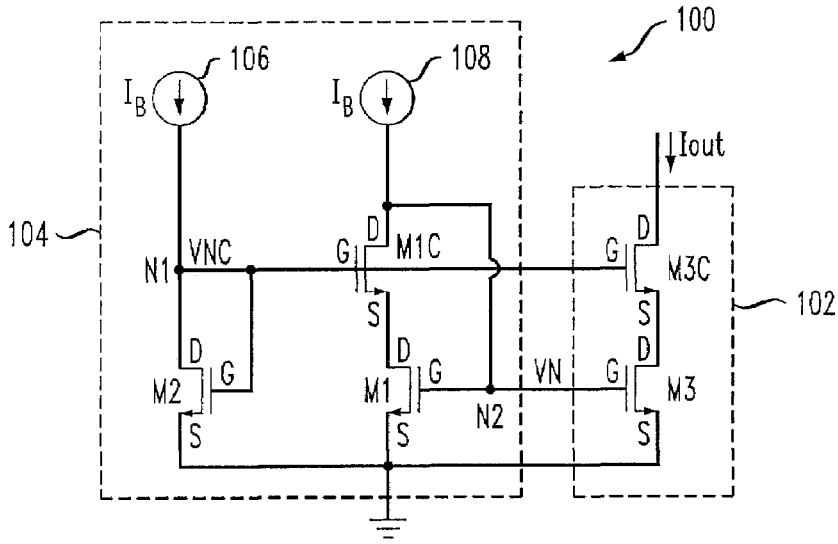
FIG. 1 (PRIOR ART)
FIG. 1 is a schematic diagram illustrating a conventional high-swing cascode current mirror.

FIG. 1 is a schematic diagram depicting a conventional high-swing cascode current mirror 100. High-swing cascode current mirror 100 includes a current sink 102 and a bias circuit 104 coupled to the current sink. Current sink 102 includes a pair of NMOS devices, M3 and M3C, arranged in a cascode configuration. Specifically, a source terminal (S) of M3 is connected to ground, a drain terminal (D) of M3 is connected to a source terminal of M3C, a gate terminal (G) of M3 receives a first bias voltage VN, a gate terminal of M3C receives a second bias voltage VNC, and a drain terminal of M3C forms an output of the current mirror 100 for generating an output current, Iout.

The bias circuit 104 generates the bias voltages VN and VNC for biasing the current sink 102. Bias circuit 104 includes an NMOS device M2 connected in a diode configuration to a first current source 106 providing a current $I_B$. Specifically, a source terminal of M2 is connected to ground, and gate and drain terminals of M2 are connected to the first current source 106 at node N1. The bias voltage VNC is generated at node N1. The bias circuit 104 further includes a pair of NMOS devices, M1 and M1C, connected in a stacked arrangement to a second current source 108 providing a current $I_B$. Specifically, a source terminal of M1 is connected to ground, a drain terminal of M1 is connected to a source terminal of M1C, a drain terminal of M1C is connected to the second current source 108, a gate terminal of M1 is connected to the drain terminal of M1C at node N2, and a gate terminal of M1C is connected to the drain terminal of M2 at node N1. The bias voltage VN is generated at node N2.

Assuming a simple saturation region metal-oxide-semiconductor (MOS) current-voltage (I-V) model, drain current, $I_D$, in each of devices M1 and M2 can be defined according to the equation $$I_D = \frac{\mu C_{OX}}{2}\left(\frac{W}{L}\right)(V_{GS} - V_T)^2, \tag{1}$$

where μ is surface mobility of a channel in the device, $C_{OX}$ is capacitance of a gate oxide per unit area in the device, W is effective channel width, L is effective channel length, $V_{GS}$ is a gate-to-source voltage of the device, and $V_T$ is a threshold voltage of the device. Since the drain currents in both devices M1 and M2 will be equal to $I_B$, as provided by current sources 108 and 106, respectively, the following equality can be defined:

$$\frac{\mu C_{OX}}{2}\left(\frac{W}{L}\right)_1(V_{GS1} - V_T)^2 = \frac{\mu C_{OX}}{2}\left(\frac{W}{L}\right)_2(V_{GS2} - V_T)^2, \tag{2}$$

where $(W/L)_1$ is an effective width-to-length ratio of device M1, $(W/L)_2$ is an effective width-to-length ratio of device M2, $V_{GS1}$ is a gate-to-source voltage of device M1, and $V_{GS2}$ is a gate-to-source voltage of device M2. From equation (2) above, the quantity $(V_{GS2}-V_T)$ can be expressed as $$V_{ON2} = V_{ON1}\sqrt{\frac{(W/L)_1}{(W/L)_2}}, \tag{3}$$

where $V_{ON2}$ in equation (3) above is defined as the quantity $(V_{GS2}-V_T)$, and $V_{ON1}$ is defined as the quantity $(V_{GS1}-V_T)$. Furthermore, the drain-to-source voltage of device M1, namely, $V_{DS1}$, is equal to $$V_{DS1}=V_{GS2}-V_{GS1C}=V_{ON2}-V_{ON1}, \tag{4}$$

where $V_{GS1C}$ is the gate-to-source voltage of device M1C.

In equation (4) above, it is assumed that device M1C is sized such that $V_{ON1C}$, which is defined as the quantity $(V_{GS1C}-V_T)$, is equal to $V_{ON1}$, and that a body effect on the threshold voltage of M1C is negligible. Additionally, in order for device M1 to be operating in the saturation region, $V_{DS1}$ must be greater than $V_{DSAT1}=V_{ON1}$, where $V_{DSAT1}$ is a minimum saturation voltage of M1. By way of example only, if device M1 is sized to be nine times larger than device M2, so that $$\left(\frac{W}{L}\right)_2 = \frac{1}{9}\left(\frac{W}{L}\right)_1, \tag{5}$$

then, using equation (3) above, $V_{ON2}=3V_{ON1}$, and the drain-to-source voltage of device M1 will be equal to $$V_{DS1}=V_{ON2}-V_{ON1}=2V_{ON1}=2V_{DSAT1} \tag{6}$$

One disadvantage of the conventional high-swing cascade current mirror 100 is that as process and temperature change, the value of $V_{ON}$ for any transistor carrying a specific drain current will vary, and thus the saturation voltage margin, $V_{DS}-V_{DSAT}$, will vary accordingly. This often results in excess margin for the saturation voltage of the primary transistors (e.g., M1 and M3) at the worst-case slow corner (e.g., high temperature and slow transistors, with low values of μ and $C_{OX}$), which at a given output voltage reduces the saturation voltage margin for the cascode devices (e.g., M1C and M3C), thereby reducing the output voltage swing of the current mirror. Furthermore, at the worst-case fast corner (e.g., low temperature and fast transistors, with high values of μ and $C_{OX}$), the saturation voltage margin of the primary transistors will be relatively low, which reduces the output resistance of the primary transistors, and thus the output resistance of current mirror 100. Additionally, the above analysis neglects the body effect in the cascode devices, since a bulk terminal (not shown) of each of the cascode devices (e.g., M1C, M3C) is not connected to its source terminal, which can significantly degrade the $V_{DS}-V_{DSAT}$ margin of the primary devices and undesirably increase the sensitivity of the current mirror 100 to PVT variations. Consequently, PVT variations make it difficult to bias a conventional high-swing cascode current mirror (e.g., current mirror 100) with a sufficient $V_{DS}-V_{DSAT}$ margin, particularly at low supply voltages (e.g., about 3.3 volts or less).

Figure 2:
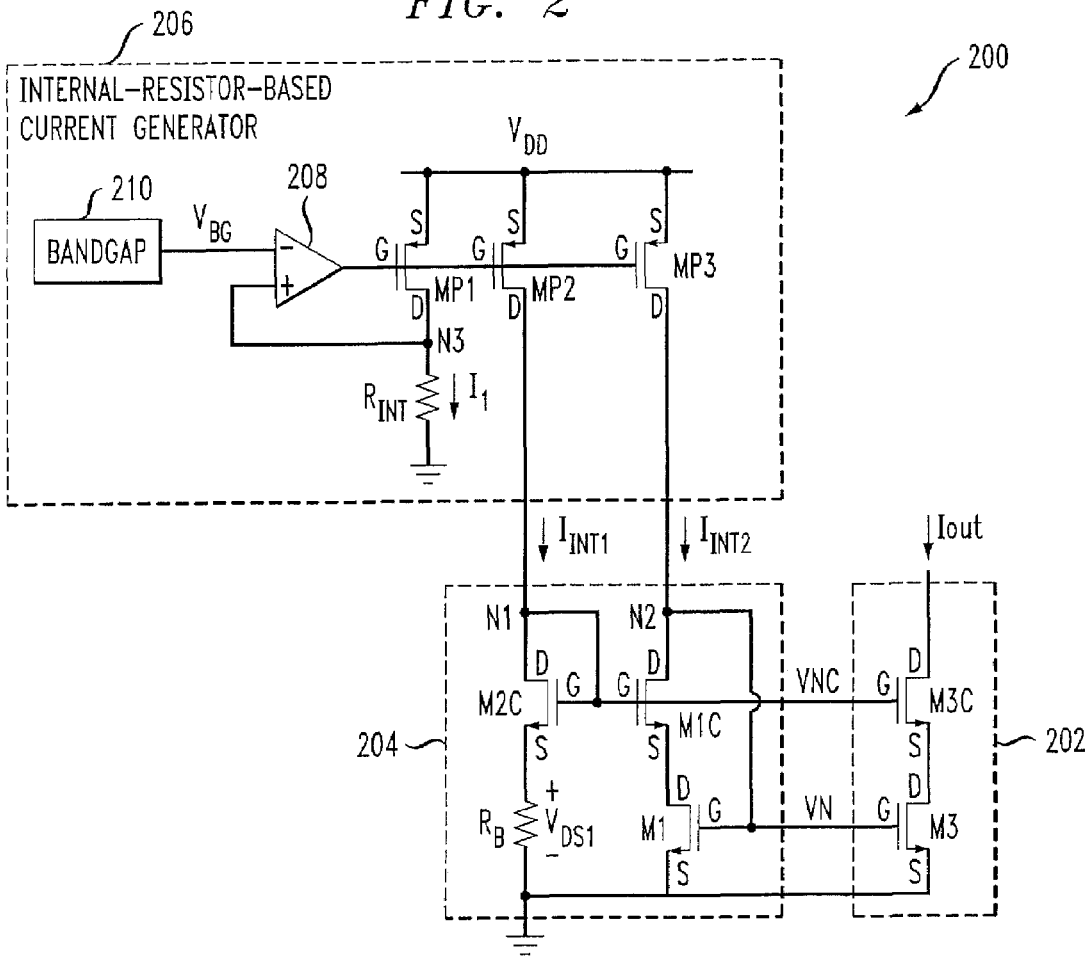
FIG. 2 is a schematic diagram illustrating an exemplary cascode bias circuit for generating bias voltages for a high-swing cascode current sink, in accordance with one embodiment of the present invention.

FIG. 2 is a schematic diagram illustrating at least a portion of an improved exemplary high-swing cascode current mirror 200, formed in accordance with one embodiment of the invention. The exemplary cascode current mirror 200 includes a cascode current sink 202, a bias circuit 204 connected to the current sink and operative to generate bias voltages for the cascode current sink, and a reference current generator 206. The current sink 202, like the cascode current sink 102 depicted in FIG. 1, preferably includes a pair of NMOS transistor devices M3 and M3C connected in a stacked configuration. Specifically, a source terminal of device M3 connects to a first source providing a first voltage, which may be ground, a drain terminal of M3 is connected to a source terminal of device M3C, a gate terminal of M3 receives a first bias voltage, VN, a drain terminal of M3C forms an output of the current mirror 200 for generating an output current, Iout, and a gate terminal of M3C receives a second bias voltage, VNC. The current mirror 200 may include a plurality of such cascode current sinks 202 for locally replicating the output current.

It is to be appreciated that, because an MOS device is symmetrical in nature, and thus bidirectional, the assignment of source and drain designations in the MOS device is essentially arbitrary. Therefore, the source and drain terminals may be referred to herein generally as first and second source/drain terminals, respectively, where the term "source/drain" in this context denotes a source terminal or a drain terminal. Furthermore, it is to be understood that, although a cascode current sink is shown including a pair of NMOS devices, the techniques of the present invention may be easily extended to provide bias voltages for a cascode current source including two or more PMOS transistor devices connected in a stacked configuration, as will be described below in conjunction with FIG. 4.

The bias voltages VN, VNC for biasing the cascode current sink 202, are preferably provided by bias circuit 204. For generating cascode bias voltage VNC, bias circuit 204 preferably includes a diode-configured NMOS transistor device M2C connecting to ground via a series bias resistor, $R_B$, or an alternative resistive element. Specifically, a drain terminal of device M2C receives a first reference current $I_{INT1}$, a gate terminal of M2C is coupled to the drain terminal of M2C at node N1, a source terminal of M2C is coupled to a first end of resistor $R_B$, and a second end of resistor $R_B$ is coupled to ground. The term "coupled" as used herein is intended to mean a direct or indirect connection. Resistor $R_B$ preferably comprises a polysilicon resistor, although alternative resistors are similarly contemplated (e.g., diffused resistor, ion implant resistor, p-well resistor, thin-film resistor, etc.), as will be known to those skilled in the art. The resistor $R_B$ preferably exhibits an I-V characteristic that is substantially linear. The cascode bias voltage VNC may be selectively controlled as a function of a resistance value of $R_B$. The bias voltage VNC for biasing the cascode device M3C in current sink 202 is generated at node N1.

For generating bias voltage VN, the bias circuit 204 further includes a pair of NMOS transistor devices M1C and M1 connected in a stacked arrangement. Specifically, a drain terminal of device M1C receives a second reference current $I_{INT2}$ which is substantially identical to $I_{INT1}$, a gate terminal of M1C is coupled to the gate terminal of M2C, a source terminal of M1C is coupled to a drain terminal of device M1, a gate terminal of M1 is coupled to the drain terminal of M1C at node N2, and a source terminal of M1 is coupled to ground. The bias voltage VN for biasing device M3 in cascode current sink 202 is generated at node N2.

The reference currents $I_{INT1}$ and $I_{INT2}$ may be generated by the reference current generator 206. It is to be understood that the present invention is not limited to the specific current generator arrangement shown. As previously stated, reference currents $I_{INT1}$ and $I_{INT2}$ are preferably substantially identical to one another, assuming devices M1C and M2C are substantially identical to one another (e.g., same W/L). The present invention similarly contemplates that the two reference currents $I_{INT1}$, $I_{INT2}$ may be different. In this instance, since the drain current of each of the devices is directly proportional to the W/L ratio of the device, as set forth in equation (1) above, it follows that the W/L ratios of devices M1C and M2C can be adjusted according to the difference in reference currents, such that $$\frac{I_{D1C}}{(W/L)_{1C}} = \frac{I_{D2C}}{(W/L)_{2C}}, \tag{7}$$

where $(W/L)_{1C}$ and $(W/L)_{2C}$ are the sizes of devices M1C and M2C, respectively, and $I_{D1C}$ and $I_{D2C}$ are the drain currents of devices M1C and M2C, respectively. For example, if reference current $I_{INT1}$ is twice that of reference current $I_{INT2}$, then the W/L ratio of device M2C should be twice that of device M1C.

Reference current generator 206 preferably includes a bandgap reference 210, or an alternative reference source, which generates a constant output voltage, $V_{BG}$, that is substantially independent of PVT variations within a desired operating range of the current mirror 200. The output voltage $V_{BG}$ from reference 210 is preferably supplied to a first input, which may be an inverting (−) input, of an operational amplifier 208. The operational amplifier 208, in conjunction with PMOS device MP1, is configured to maintain a voltage at node N3 of the reference current generator 206 that is substantially equal to $V_{BG}$. Specifically, a source terminal of MP1 connects to a second source providing a second voltage, which may be $V_{DD}$, a gate terminal of MP1 is connected to an output of operational amplifier 208, and a drain terminal of MP1 is connected to a second input, which may be a non-inverting (+) input, of the operational amplifier at node N3.

The reference current generator 206 preferably includes an internal reference resistor, $R_{INT}$, connected to node N3 at a first end, and connecting to ground at a second end. The resistance value of $R_{INT}$, along with the value of $V_{BG}$, establishes a reference current I1 which flows through device MP1. The value of reference current I1 may be determined according to the equation $I1=V_{BG}/R_{INT}$, neglecting any offsets (e.g., input offset) introduced by the operational amplifier 208. Since $V_{BG}$ is substantially independent of PVT variations, it is apparent from the above equation that the reference current I1 will vary inversely with $R_{INT}$. Consequently, it is preferred that resistor $R_{INT}$ be an on-chip resistor, like resistor $R_B$ in the bias circuit 204, so that $R_B$ will be ratio matched to $R_{INT}$. The term "ratio matched" as used herein is intended to imply that a ratio of two quantities, for example, the resistance values of $R_B$ and $R_{INT}$, is substantially constant over PVT variations. Thus, a ratio of $R_B$ to $R_{INT}$ will be substantially constant. In this manner, bias circuit 204 provides bias voltages VNC, VN for biasing the cascode current sink 202, such that the output current Iout, which is a function of the reference current I1, is substantially independent of PVT variations.

The reference current I1 is preferably mirrored by PMOS devices MP2 and MP3, each device having gate and source terminals coupled to the gate and source terminals, respectively, of device MP1. A drain terminal of MP2 preferably connects to the bias circuit 204 at node N1, and a drain terminal of MP3 is coupled to node N2 in the bias circuit. Since the gate-to-source voltages ($V_{GS}$) of devices MP1, MP2 and MP3 will essentially be identical to one another, the reference currents $I_{INT1}$ and $I_{INT2}$, generated by devices MP2 and MP3, respectively, will be substantially matched to reference current I1, assuming devices MP1, MP2, MP3 are all sized the same, and assuming drain voltages of MP2 and MP3 at nodes N1 and N2, respectively, are substantially the same as a drain voltage of MP1 at node N3, which in this instance will be about equal to $V_{BG}$. It is similarly contemplated that reference currents $I_{INT1}$ and $I_{INT2}$, which are preferably equal to one another, may be different than reference current I1. For example, by making the W/L ratios of devices MP2 and MP3 twice that of device MP1, the reference currents $I_{INT1}$ and $I_{INT2}$ will be twice that of reference current I1, as will be understood by those skilled in the art. It will be further understood by those skilled in the art that it is possible to make $I_{INT2}$ different from $I_{INT1}$ by making the W/L ratio of MP3 different from that of MP2.

If $I_{INT1}=I_{INT2}$ and the sizes of M1C and M2C are substantially equal, or if $(W/L)_{1C}$, $(W/L)_{2C}$, $I_{INT1}$, and $I_{INT2}$ are scaled in such a way that they satisfy equation (7), then $V_{GS1C}$ will be substantially equal to $V_{GS2C}$. Thus, the drain-to-source voltage of primary transistor M1, $V_{DS1}$, will be equal to the voltage drop across resistor $R_B$ in bias circuit 204, which in turn is equal to $I_{INT1}\times R_B$. From the previous discussion, $$I_{INT1} = \frac{(W/L)_{P2}}{(W/L)_{P1}} I_1 = \frac{(W/L)_{P2}}{(W/L)_{P1}} \left(\frac{V_{BG}}{R_{INT}}\right) \tag{8}$$

and thus the voltage drop across resistor $R_B$ is equal to $$V_{DS1} = \frac{(W/L)_{P2}}{(W/L)_{P1}} \left(\frac{R_B}{R_{INT}}\right) V_{BG} \tag{9}$$

Thus, by choosing appropriate ratios for $(W/L_{P2}/(W/L)_{P1}$ and for $R_B/R_{INT}$, the drain-to-source voltage of transistor M1, and by extension of transistor M3 in current sink 202, will be substantially equal to a fraction or a multiple of the bandgap voltage, $V_{BG}$. Since $V_{BG}$ and the ratios $(W/L)_{P2}/(W/L)_{P1}$ and $R_B/R_{INT}$ are substantially PVT independent, the drain-to-source voltages of primary transistors M1 and M2 will be substantially PVT independent. As a result, the $V_{DS}-V_{DSAT}$ margins for the primary transistors may have significantly less sensitivity to PVT variations than in the standard cascode current mirror 100 shown in FIG. 1.

Reference current generator 206 is preferably integrated on the same semiconductor substrate as the bias circuit 204, and may reside within the bias circuit, so as to provide better matching of circuit components (e.g., transistor devices and resistors) between the bias circuit and the reference current generator. Alternatively, current generator 206 may reside externally with respect to the current mirror. In either case, resistors $R_{INT}$ and $R_B$ are preferably substantially ratio matched to one another.

Figure 3:
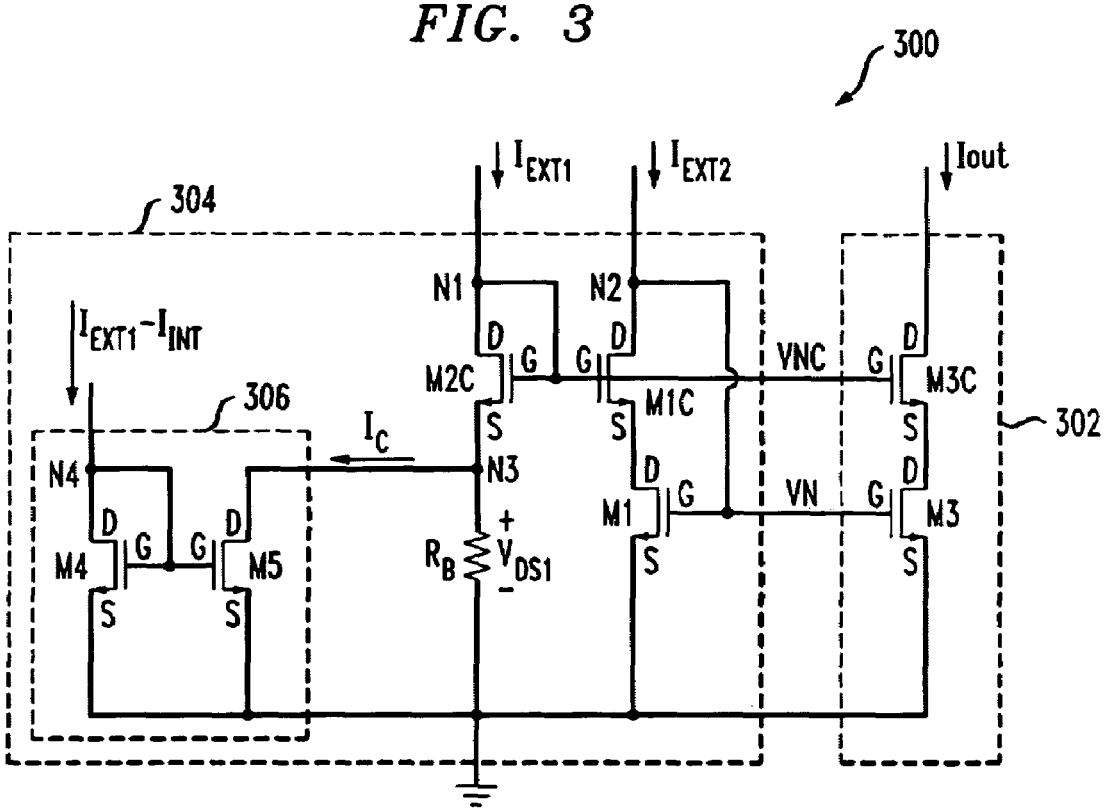
FIG. 3 is a schematic diagram depicting at least a portion of an exemplary cascode bias circuit for generating bias voltages for a high-swing cascode current source, in accordance with another embodiment of the present invention.

FIG. 3 is a schematic diagram illustrating at least a portion of an exemplary high-swing cascode current mirror 300, formed in accordance with a second embodiment of the invention. This second embodiment is preferably employed in current mirrors which are used to mirror currents that do not inversely track an on-chip resistor. The exemplary cascode current mirror 300 includes a cascode current sink 302, and a bias circuit 304 connected to the current sink and operative to generate bias voltages, VN and VNC, for the cascode current sink. The cascode current sink 302 is essentially identical to the cascode current sink 202 depicted in FIG. 2. The bias circuit 304 is substantially the same as bias circuit 204 shown in FIG. 2, except that bias circuit 304 has been modified slightly for receiving first and second reference currents, $I_{EXT1}$ and $I_{EXT2}$. Although they are preferably substantially equal, or at least proportional to each other, reference currents $I_{EXT1}$ and $I_{EXT2}$ may otherwise be arbitrary, and thus may not be ratio matched to bias resistor $R_B$ in bias circuit 304. For example, reference currents $I_{EXT1}$ and $I_{EXT2}$ may be based on an off-chip resistor (not shown) or may be generated by a current generator whose characteristics are independent of the resistor used in bias circuit 304. Consequently, the reference currents $I_{EXT1}$ and $I_{EXT2}$ will not accurately track changes of the bias resistor $R_B$ with PVT variations.

A core portion of bias circuit 304, comprising NMOS devices M1, M1C and M2C, and resistor $R_B$, is preferably arranged identical to bias circuit 204 shown in FIG. 2. Specifically, drain and gate terminals of device M2C are preferably connected together at node N1, a source terminal of M2C is connected to a first end of resistor $R_B$ at node N3, and a second end of $R_B$ connects to a first source providing a first voltage, which may be ground. The voltage $V_{DS1}$ developed across resistor $R_B$ will be equal to $I_{EXT1}\times R_B$. Cascode bias signal VNC is generated at node N1 in response to node N1 receiving first reference current $I_{EXT1}$. For generating the bias voltage VN, a drain terminal of device M1C receives a second reference current $I_{EXT2}$ which is preferably substantially identical to $I_{EXT1}$, a gate terminal of M1C is connected to the gate terminal of M2C, a source terminal of M1C is connected to a drain terminal of device M1, a gate terminal of M1 is connected to the drain terminal of M1C, and a source terminal of M1 connects to ground. The bias voltage VNC for biasing the cascode devices M1C and M3C is generated at the drain terminal of device M2C, and the bias voltage VN for biasing device M3 is generated at the drain terminal of device M1.

In order to improve the independence of the bias circuit 304 to PVT variations, a compensation circuit 306 may be included in the bias circuit. The compensation circuit 306 is preferably operative to subtract a compensation current $I_C$ from node N3, such that a net current flowing through resistor $R_B$ will be based predominantly on an on-chip resistor that is substantially ratio matched to resistor $R_B$. The current $I_C$ preferably comprises a first component that is substantially matched to the reference current $I_{EXT1}$, and a second component $I_{INT}$ that is inversely proportional to an on-chip resistor that is ratio matched to resistor $R_B$. Compensation current $I_C$ has a value preferably equal to $I_{EXT1}-I_{INT}$. Thus, the current flowing through resistor $R_B$ will be equal to $I_{EXT1}-I_C=I_{INT}$, and thus voltage $V_{DS1}$ across resistor $R_B$, which is substantially equal to the drain-to-source voltage of transistor M1, will be equal to $I_{INT}\times R_B$. Just as in the bias circuit 204 shown in FIG. 2, this voltage is substantially independent of PVT variations.

The compensation circuit 306 preferably comprises a pair of NMOS transistor devices M4 and M5 connected in a simple current mirror configuration. Specifically, a drain terminal of device M4 receives a current equal to $I_{EXT1}-I_{INT}$, gate terminals of M4 and M5 are connected to the drain terminal of M4 at node N4, source terminal of M4 and M5 connect to ground, and a drain terminal of M5 is connected to the source terminal of M2C at node N3. Since a drain-to-source voltage of device M5 is substantially constant, the current mirror including devices M4 and M5 may be implemented by a simple non-cascoded current mirror as shown, without impacting power supply rejection. Alternative compensation circuits suitable for use with the present invention are similarly contemplated.

Figure 4:
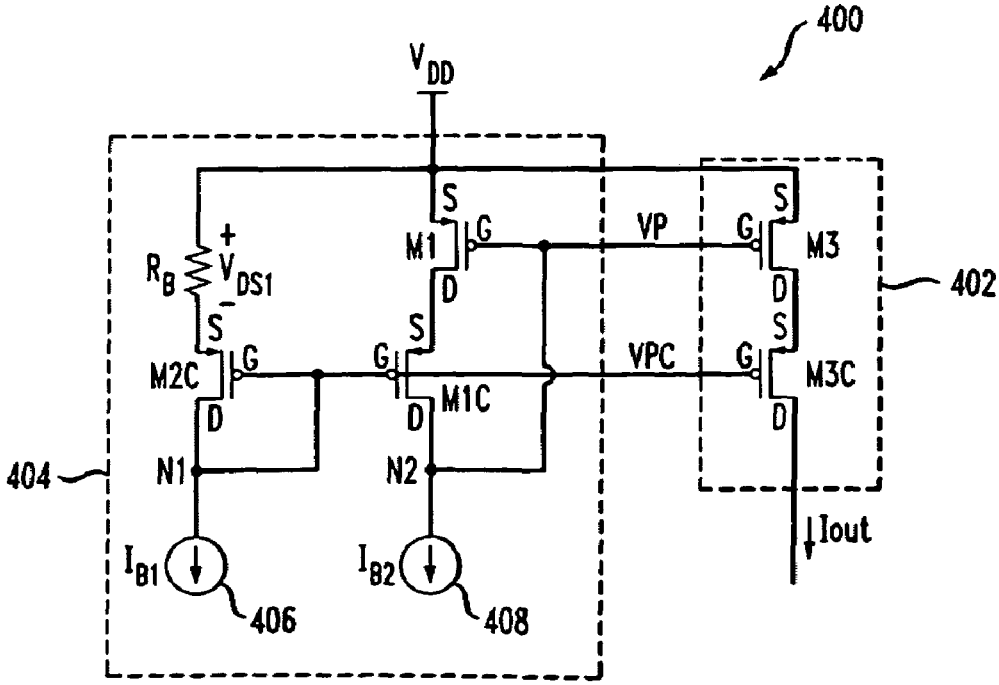
FIG. 4 is a schematic diagram illustrating an exemplary cascode bias circuit for generating bias voltages for a high-swing cascode current source, in accordance with an embodiment of the present invention.

FIG. 4 is a schematic diagram illustrating at least a portion of an exemplary high-swing cascode current mirror 400, formed in accordance with a third embodiment of the invention. The exemplary cascode current mirror 400 includes a cascode current source 402, and a bias circuit 404 connected to the current source and operative to generate bias voltages for the cascode current source. As apparent from the figure, the current mirror 400 is essentially the same as the illustrative current mirror 200 shown in FIG. 2, except that the circuit is flipped upside down, and all NMOS devices have been replaced by PMOS devices. The current source 402 preferably includes a pair of PMOS transistor devices M3 and M3C connected in a stacked configuration. Specifically, a source terminal of device M3 connects to a first source providing a first voltage, which may be $V_{DD}$, a drain terminal of M3 is connected to a source terminal of device M3C, a gate terminal of M3 receives a first bias voltage, VP, a drain terminal of M3C forms an output of the current mirror 400 for generating an output current, Iout, and a gate terminal of M3C receives a second bias voltage, VPC.

The bias voltages VP, VPC for biasing the cascode current source 402, are preferably provided by bias circuit 404. For generating cascode bias voltage VPC, bias circuit 404 preferably includes a diode-configured PMOS transistor device M2C connecting to $V_{DD}$ via a series bias resistor, $R_B$, or an alternative resistive element. Specifically, gate and drain terminals of device M2C are connected to a first current source 406 providing a bias current $I_{B1}$ at node N1, a source terminal of M2C is connected to a first end of resistor $R_B$, and a second end of resistor $R_B$ connects to $V_{DD}$. Resistor $R_B$ preferably exhibits an I–V characteristic that is substantially linear. The cascode bias voltage VPC, which is generated at node N1, may be selectively controlled as a function of a resistance value of $R_B$.

For generating bias voltage VP, the bias circuit 404 further includes a pair of PMOS transistor devices M1C and M1 connected in a stacked arrangement. Specifically, a drain terminal of device M1C is connected to a second current source 408 providing a bias current $I_{B2}$, a gate terminal of M1C is connected to the gate terminal of M2C, a source terminal of M1C is connected to a drain terminal of device M1, a gate terminal of M1 is connected to the drain terminal of M1C at node N2, and a source terminal of M1 connects to $V_{DD}$. The bias voltage VP for biasing device M3 in cascode current source 402 is generated at node N2.

Although depicted in current mirror 400 as being ideal sources 406, 408, bias currents $I_{B1}$ and $I_{B2}$ may be provided by a reference current generator (not shown). The reference current generator may be configured in a manner similar to current generator 206 shown in FIG. 2, except that the circuit will be essentially flipped upside down, and the PMOS devices in current generator 206 replaced by NMOS devices, as will be understood by those skilled in the art. Bias currents $I_{B1}$ and $I_{B2}$ are preferably a function of an on-chip resistive element which is ratio matched to resistor $R_B$. In this manner, bias voltages VP and VPC will be substantially independent of PVT variations to which the current mirror 400 may be subjected. In the case where bias currents $I_{B1}$ and $I_{B2}$ are independent of an on-chip resistor, for example, where $I_{B1}$ and $I_{B2}$ are based on an external resistor (not shown), compensation circuitry similar to compensation circuit 306 depicted in FIG. 3, may be included in the bias circuit 404, only with the NMOS devices replaced by PMOS devices.

At least a portion of the bias circuits of the present invention may be implemented in an integrated circuit. In forming integrated circuits, a plurality of identical die is typically fabricated in a repeated pattern on a surface of a semiconductor wafer. Each die includes a device described herein, and may include other structures and/or circuits. The individual die are cut or diced from the wafer, then packaged as an integrated circuit. One skilled in the art would know how to dice wafers and package die to produce integrated circuits. Integrated circuits so manufactured are considered part of this invention.

Although illustrative embodiments of the present invention have been described herein with reference to the accompanying drawings, it is to be understood that the invention is not limited to those precise embodiments, and that various other changes and modifications may be made therein by one skilled in the art without departing from the scope of the appended claims.

What is claimed is:

1. A bias circuit for providing at least first and second bias signals for biasing at least one of a cascode current source and a cascode current sink, the bias circuit comprising:

a first transistor including first and second source/drain terminals and a gate terminal, the first source/drain terminal being coupled to the gate terminal, the first bias signal being generated at the first source/drain terminal in response to receiving a first reference current at the first source/drain terminal;

a first resistive element including first and second ends, the first end of the first resistive element being coupled to the second source/drain terminal of the first transistor;

a second transistor including first and second source/drain terminals and a gate terminal, the gate terminal of the second transistor being connected to the gate terminal of the first transistor, the second bias signal being generated at the first source/drain terminal of the second transistor in response to receiving a second reference current at the first source/drain terminal of the second transistor;

a third transistor including first and second source/drain terminals and a gate terminal, the first source/drain terminal of the third transistor being coupled to the second source/drain terminal of the second transistor, the second source/drain terminal of the third transistor being coupled to the second end of the first resistive element, and the gate terminal of the third transistor being coupled to the first source/drain terminal of the second transistor; and a compensation circuit operative to subtract at least a portion of current flowing through the first resistive element, such that a net current flowing through the first resistive element is substantially a function of a resistance of a second resistive element which is ratio matched to a resistance of the first resistive element.

2. The circuit of claim 1, wherein each of the first, second and third transistors comprises an NMOS device.

3. The circuit of claim 1, wherein each of the first, second and third transistors comprises a PMOS device.

4. The circuit of claim 1, wherein a voltage across the first resistive element is substantially matched to a voltage across the first and second source/drain terminals of the third transistor.

5. The circuit of claim 1, wherein a voltage across the first resistive element is selected to be greater than or substantially equal to a worst-case minimum saturation voltage of the third transistor for a desired operating range of the bias circuit.

6. The circuit of claim 1, wherein the first transistor is substantially matched to the second transistor, and wherein the first and second reference currents are substantially equal to one another.

7. The circuit of claim 1, wherein the first and second reference currents are a provided by a reference generator comprising the second resistive element, the first and second reference currents being a function of the second resistive element, a ratio of the first and second resistive elements being substantially constant over at least one of process, voltage and temperature variations to which the bias circuit is subjected.

8. The circuit of claim 1, wherein the first and second reference currents are provided by a reference generator comprising the second resistive element, the first and second reference currents being inversely proportional to the second resistive element, a ratio of the first and second resistive elements being substantially constant over at least one of process, voltage and temperature variations to which the bias circuit is subjected.

9. A bias circuit for providing at least first and second bias signals for biasing at least one of a cascode current source and a cascode current sink, the bias circuit comprising:

a first transistor including first and second source/drain terminals and a gate terminal, the first source/drain terminal being coupled to the gate terminal, the first bias signal being generated at the first source/drain terminal in response to receiving a first reference current at the first source/drain terminal;

a first resistive element including first and second ends, the first end of the first resistive element being coupled to the second source/drain terminal of the first transistor;

a second transistor including first and second source/drain terminals and a gate terminal, the gate terminal of the second transistor being connected to the gate terminal of the first transistor, the second bias signal being generated at the first source/drain terminal of the second transistor in response to receiving a second reference current at the first source/drain terminal of the second transistor;

a third transistor including first and second source/drain terminals and a gate terminal, the first source/drain terminal of the third transistor being coupled to the second source/drain terminal of the second transistor, the second source/drain terminal of the third transistor being coupled to the second end of the first resistive element, and the gate terminal of the third transistor being coupled to the first source/drain terminal of the second transistor;

a fourth transistor including first and second source/drain terminals and a gate terminal, the first source/drain terminal of the fourth transistor being coupled to the gate terminal of the fourth transistor, and the second source/drain terminal of the fourth transistor being coupled to the second end of the first resistive element; and a fifth transistor including first and second source/drain terminals and a gate terminal, the first source/drain terminal of the fifth transistor being coupled to the first end of the first resistive element, the second source/drain terminal of the fifth transistor being coupled to the second end of the first resistive element, and the gate terminal of the fifth transistor being coupled to the gate terminal of the fourth transistor.

10. The circuit of claim 9, wherein each of the fourth and fifth transistors comprises an NMOS device.

11. The circuit of claim 9, wherein the first and second reference currents are substantially selectively controlled as a function of a resistance of an off-chip resistor, and the first source/drain terminal of the fourth transistor receives a third reference current which is subtracted from the first reference current, the third reference current being a function of both the resistance of the off-chip resistor and a resistance of the first resistive element, such that a current flowing through the first resistive element generates a voltage drop across the first resistive element that is substantially independent of at least one of process, voltage and temperature variations to which the bias circuit is subjected.

12. The circuit of claim 9, wherein the first and second reference currents are substantially independent of a resistance of the first resistive element, and the first source/drain terminal of the fourth transistor receives a third reference current which is substantially equal to a difference between the first reference current and a fourth reference current which is substantially inversely proportional to the resistance of the first resistive element, such that a current flowing through the first resistive element generates a voltage drop across the first resistive element that is substantially independent of at least one of process, voltage and temperature variations to which the bias circuit is subjected.

13. The circuit of claim 12, wherein the first and second reference currents are selectively controlled as a function of a resistance of an off-chip resistor.

14. An integrated circuit including at least one bias circuit for providing at least first and second bias signals for biasing at least one of a cascode current source and a cascode current sink, the at least one bias circuit comprising:

a first transistor including first and second source/drain terminals and a gate terminal, the first source/drain terminal being coupled to the gate terminal, the first bias signal being generated at the first source/drain terminal in response to receiving a first reference current at the first source/drain terminal;

a first resistive element including first and second ends, the first end of the first resistive element being coupled to the second source/drain terminal of the first transistor;

a second transistor including first and second source/drain terminals and a gate terminal, the gate terminal of the second transistor being connected to the gate terminal of the first transistor, the second bias signal being generated at the first source/drain terminal of the second transistor in response to receiving a second reference current at the first source/drain terminal of the second transistor;

a third transistor including first and second source/drain terminals and a gate terminal, the first source/drain terminal of the third transistor being coupled to the second source/drain terminal of the second transistor, the second source/drain terminal of the third transistor being coupled to the second end of the first resistive element, and the gate terminal of the third transistor being coupled to the first source/drain terminal of the second transistor; and a compensation circuit operative to subtract at least a portion of current flowing through the first resistive element, such that a net current flowing through the first resistive element is substantially a function of a resistance of a second resistive element which is ratio matched to a resistance of the first resistive element.

15. The integrated circuit of claim 14, wherein a voltage across the first resistive element is substantially matched to a voltage across the first and second source/drain terminals of the third transistor.

16. The integrated circuit of claim 14, wherein a voltage across the first resistive element is selected to be greater than or substantially equal to a worst-case minimum saturation voltage of the third transistor for a desired operating range of the bias circuit.

17. The integrated circuit of claim 14, wherein the first and second reference currents are a provided by a reference generator comprising the second resistive element, the first and second reference currents being a function of the second resistive element, a ratio of the first and second resistive elements being substantially constant over at least one of process, voltage and temperature variations to which the bias circuit is subjected.

18. The integrated circuit of claim 14, wherein the first and second reference currents are a provided by a reference generator comprising the second resistive element, the first and second reference currents being inversely proportional to the second resistive element, a ratio of the first and second resistive elements being substantially constant over at least one of process, voltage and temperature variations to which the bias circuit is subjected.

* * * * *

UNITED STATES PATENT AND TRADEMARK OFFICE

CERTIFICATE OF CORRECTION

PATENT NO. : 7,208,998 B2
APPLICATION NO. : 11/103813
DATED : April 24, 2007
INVENTOR(S) : C. J. Abel It is certified that error appears in the above-identified patent and that said Letters Patent is hereby corrected as shown below:

Col. 11, line 28, please delete "are a provided" and insert --are provided--.

Signed and Sealed this

Fourteenth Day of August, 2007

JON W. DUDAS
*Director of the United States Patent and Trademark Office*